United States Patent [19]

Deas

[11] 4,386,569

[45] Jun. 7, 1983

[54] SOLID PROPELLANT GRAIN FOR IMPROVED BALLISTIC PERFORMANCE GUNS

[75] Inventor: Robert W. Deas, Aberdeen, Md.

[73] Assignee: The United States of America as represented by the Secretary of the Army, Washington, D.C.

[21] Appl. No.: 191,656

[22] Filed: Sep. 26, 1980

Related U.S. Application Data

[63] Continuation-in-part of Ser. No. 43,767, May 30, 1979, abandoned.

[51] Int. Cl.[3] ..... C06D 5/06

[52] U.S. Cl. ..... 102/292; 102/285; 102/291

[58] Field of Search ..... 102/287–292

[56] References Cited

U.S. PATENT DOCUMENTS

| | | | |
|---|---|---|---|
| 321,374 | 6/1895 | Lyman | 102/289 X |
| 3,226,928 | 1/1966 | Webb et al. | 102/291 X |
| 3,296,794 | 1/1967 | Nash | 102/289 X |
| 3,418,811 | 12/1968 | Caveny et al. | 102/289 X |
| 4,094,248 | 6/1978 | Jacobson | 102/288 |

*Primary Examiner*—Peter A. Nelson

*Attorney, Agent, or Firm*—Nathan Edelberg; Robert P. Gibson; Max Yarmovsky

[57] ABSTRACT

A propellant grain for improved ballistic performance of guns, the grain comprising a cylinder of generally hexagonal cross-section being provided with a plurality of perforations, preferably 37, passing therethrough. The perforations are disposed such that the interstitial distance between adjacent perforations is substantially equal and the extrastitial distance between peripheral perforations and the surface of the outer wall is substantially equal to the aforesaid interstitial distance. The novel shape of the solid propellant grain improves ignition and burning characteristics such that higher average pressures are maintained during projectile acceleration without increasing the maximum pressure within the gun barrel.

6 Claims, 6 Drawing Figures

SOLID PROPELLANT GRAIN FOR IMPROVED BALLISTIC PERFORMANCE GUNS

GOVERNMENTAL INTEREST

The invention described herein may be manufactured, used and licensed by or for the Government for Governmental purposes without the payment to me of any royalty thereon.

This application is a continuation-in-part of a prior application, Ser. No. 043,767 filed May 30, 1979, now abandoned, of Robert W. Deas for a Solid Propellant Grain For Improved Ballistic Performance Guns.

BACKGROUND OF THE INVENTION

This invention has to do with propellants for use in gun systems. More specifically, this invention has to do with a novel shape for propellant grains which enhances the burning characteristics of the propellant material such as to achieve higher muzzle velocity of a projectile without increasing the maximum experienced pressure within the barrel of the gun in use.

As is well known, the purpose of propellant materials in a gun system is to provide a source of energy for accelerating a projectile within the bore of a gun so that a desired muzzle velocity for the projectile is achieved. The projectile, initially at rest, is accelerated by force resulting from the generation of high pressure gaseous products in response to the ignition and burning of the propellant material.

As is also generally known, the burning of solid propellants ordinarily utilized in gun systems is initiated by some action, e.g. the release of a firing pin, which generates a small amount of hot gas in proximity to the propellant thus causing the propellant material to ignite and the burn process to commence.

Once ignition is achieved, it is desirable to have the propellant burn in a controlled manner from the surface of the propellant grains inwardly. Where the burn is essentially uniform over the whole propellant grain, the surface receeds parallel to itself, gas is generated evenly and the resulting pressure accelerates the projectile down the bore.

As is also well known in the arts, the ultimate or muzzle velocity of a projectile thus accelerated is related to and dependent upon the pressure-time history after ignition. Thus maximum pressure achieved during the burn as well as the magnitude of the sustained pressure after maximum has been reached are the primary factors in being able to achieve desired muzzle velocity within the limitations of acceptable gun structure.

For purposes of understanding fully the present invention, it is considered to be worthwhile to review the relationships of various factors which have an effect on muzzle velocity in any particular gun system.

The differential equations governing the acceleration of a projectile down the bore of a gun to a desired velocity are Newton's Law and the Propellant Burning Law respectively:

$$PA - f = m\frac{d^2x}{dt^2} \text{ (Newton's Law)} \quad (1)$$

$$\frac{dC}{dt} = S\frac{dr}{dt} \text{ (Propellant Burning Law)} \quad (2)$$

where:

P=Pressure acting on base of projectile
A=bore area
f=engraving and frictional force
m=mass of projectile
x=projectile travel
C=mass of propellant burned
=density of solid propellant
S=surface area of solid propellant
(dr/dt)=propellant rate of surface regression
t=time The launch velocity, from equation (1) Newton's Law is:

$$\frac{dx}{dt} = v = \frac{1}{m}\int_0^{tm}(PA - f)dt$$

where:

v=velocity
$t_m$=time to travel to forward end or muzzle, of gun.

Because the friction factor in equation (1) i.e. the equation for Newton's law, is a small constant, it is clear that muzzle velocity is essentially proportional to the integral of the pressure-time history for a projectile starting from rest. Clearly, therefore, muzzle velocity can be increased by increasing the maximum pressure. However, as is discussed below, increasing maximum pressure is not an acceptable approach in many instances because of inherent limitation in presently known gun structures as well as because of the resultant fatigue stresses which shorten gun life. Further, increased maximum pressures are known to cause damage to projectiles some time with catastrophic failure of the weapon. Thus, improvement of muzzle velocity by increasing the maximum pressure during acceleration is not the most desirable approach to the problem.

Considering therefore the Propellant Burning Law, see equation (2) it can be seen that this law relates to the rate of gas evolution of the burning propellant material. The pressure time history generated thereby is the result of comparing the rate of pressure generation as a result of propellant burn with the increase in the volume of the gun chamber resulting from projectile displacement. As the propellant is initially ignited and gases are being generated, the projectile is either at rest or moving relatively slowly. Thus, gases are being generated faster than the volume of the chamber is increasing. Clearly as a result of this, the pressure experienced increases.

As the projectile accelerates down the gun bore, the volume of the chamber increases at a rate which ultimately surpasses the rate of gas generation by the burning of the propellant material. The transition corresponds to the point of maximum pressure in the chamber. Thereafter the pressure decreases as the projectile continues to accelerate thus increasing the volume of the gun chamber at a rate faster than the increase in volume of gases being generated by the propellant burn.

It has been recognized by those skilled in these arts that the rate of burn of propellant material i.e. the burn characteristics of the grain, is a function not only of the physical and chemical characteristics of the material itself but also of the shape of the grain. Known grain designs are ordinarily cylindrical elements having a single perforation therethrough or seven perforations therethrough. It has been found that grain designs having these characteristics are limited in their capability for extending of a relatively high degree of chamber pressure after the maximum pressure has been achieved. Thus, increases in muzzle velocities have been required to be achieved by increasing the maximum pressure in the gun system. However, as will be recognized by those skilled in these arts, such increases in maximum pressure are extremely expensive and result in difficult operational problems because of the requirement for increased structural capabilities of the cannon, rolling stock, support stock, and the like.

Prior attempts to achieve a higher sustained pressure subsequent to the achievement of maximum pressure have not been successful nor, for economic reasons, has it been found acceptable to resort to more esoteric propellant materials.

Typical prior art approaches may be seen by way of example in U.S. Pat. No. 4,094,248; U.S. Pat. No. 3,429,624; British Pat. No. 7178 and French Pat. No. 1,595,508.

In U.S. Pat. No. 4,094,248 there is described a hexoganol grain with 7 internal perforations centered on the vertices of equilateral triangles, with each grain having external longitudinal grooves. This geometry does not provide for progressive burning and performance characteristics. Further, there exists gaps between the faces of adjacent propellant grains which would permit burning to take place on the face as well as the external grooves such that the actual performance of the grain design as disclosed in the patent will be similar to that of the 7 perforation cylindrical grains which are the standard U.S. gun propellant geometry.

U.S. Pat. No. 3,429,264 described a solid stick propellant with a grooved hexoganol-like periphery which can be used in place of tubular propellant in rockets. There is no provision for perforations. Further, the patent teaches degressive burning, i.e. rapid initial burning and slower burning in final stages. This concept is diametrically opposite to that concept disclosed in the present application which provides for progressive burning which is essential to improved gun performance.

French Pat. No. 1,595,508 describes a block of propellant formed by bonding individual propellant grains together in a matrix. The progressive burning achieved pursuant to this approach is the result of burning on the external surfaces as being inhibited by the bonding agent.

British Pat. No. 7178 describes perforated propellants, perforations of which are of a shape other than cylindrical. Further, in order to maintain the equal distance, the British Patent teaches the use of grooves on the periphery to maintain the same web throughout the grain.

BRIEF STATEMENT OF THE INVENTION

It is an object of the present invention, therefore, to provide a solid propellant grain for improved ballistic performance of guns which permits achievement of increased muzzle velocities of projectiles without requiring increased maximum pressure.

Another object of the present invention is to provide a solid propellant grain for improved ballistic performance of guns wherein increased muzzle velocities of projectiles can be achieved without the necessity for increasing the structural capability of the weapon.

Yet another object of the present invention is to provide a solid propellant grain for improved ballistic performance in guns without the need or great capital investment in terms of manufacturing facilities and techniques i.e. to the use of presently known manufacturing technology.

It is still a further object of the present invention to provide a solid propellant grain for improved ballistic performance of guns wherein the grain achieves progressive burning i.e. improved burn area as the propellant material is burned whereby to achieve increased gas generation subsequent to the achievement of maximum gas pressure within the gun chamber.

These objects and others not enumerated are achieved by a solid grain propellant according to the present invention, one embodiment of which may include a propellant grain of generally cylindrical shape having a plurality of longitudinal substantially parallel perforations extending therethrough, the cross-sectional locations of said perforations being such that the interstitial distances between adjacent perforations is substantially equal and substantially equals the extrastitial distances between the perimetric perforations and the outer surface of the grain wall.

BRIEF DESCRIPTION OF THE DRAWINGS

A more complete understanding of the present invention may be had from the following detailed description thereof, particularly when read in the light of the accompanying drawings wherein.

DETAILED DESCRIPTION

As noted above this invention relates to a solid propellant grain structure for improved ballistic performance.

Figure 1:
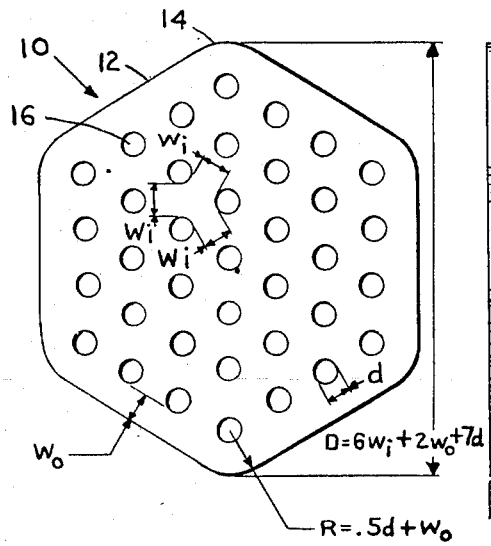
FIG. 1 is a cross-sectional view of an embodiment of propellant grain structured in accordance with the present invention.
Figure 2:
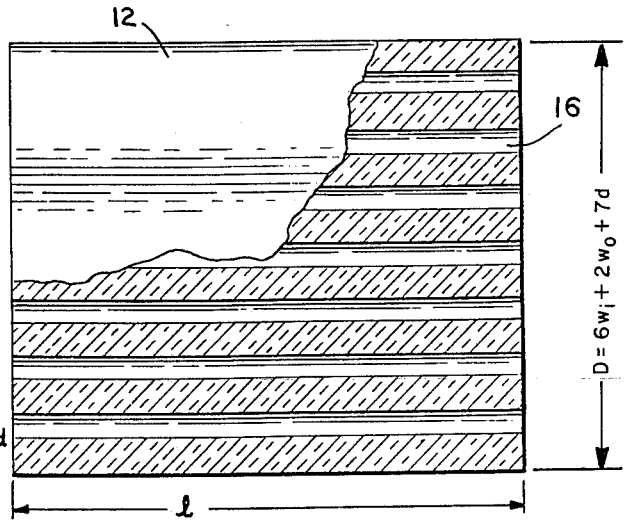
FIG. 2 is a longitudinal cross-sectional view of the solid propellant grain of FIG. 1.

Referring therefore to the drawings and in particular FIGS. 1 and 2, there are shown cross-sectional views of a solid propellant grain structured in accordance with the present invention.

Referring particularly to FIG. 1, it can be seen that the grain, designated generally by the reference numberal 10, is generally hexagonal in cross-section having six flat outer surfaces 12 joined by rounded longitudinal edges 14.

Extending longitudinally through grain 10 are a plurality of parallel throughbores 16. The positioning of throughbores 16 is critical and thus there is shown on FIG. 1 the dimensional relationship of the respective throughbores.

The throughbores may be designated generally as internal throughbores and perimetric throughbores. The perimetric throughbores or perforations are those throughbores which are adjacent on one side the the peripheral surface of grain 10. The internal throughbores or perforations are the remaining throughbores which are within the hexagonal design of throughbores or perforations defined by the perimetric perforations.

Each of the internal throughbores or perforations is equally distant from each of the immediately surrounding throughbores or perforations. Thus, there is defined between adjacent throughbores along a line which connects their axes a wall having a thickness $W_i$ as shown on the drawing. Thus the distance between the centers of adjacent throughbores or perforations is $W_i+d$ where d is the diameter of the through bore.

With respect to the location perimetric perforations from the outer surface of the grain, each throughbores or perforation is disposed such that the thickness of grain material between the throughbores and the surface of the grain, measured along a line perpendicular to the surface of the grain and passing through the axial center of the throughbore, dimension $W_o$ as shown in FIG. 1 is equal to $W_i$, i.e. the thickness of grain material between adjacent internal throughbores.

With respect to those throughbores which are immediately adjacent the edges 14 of the external surface of the grain, the wall thickness is maintained at the $W_o$ dimension by rounding the edge 14 utilizing a radius arc which is equal to one-half the diameter of the perforation plus the dimension $W_o$.

An optimum grain structure in accordance with the invention has been found to include seven perforations along the line connecting opposite edges 14. So structured the total number of perforations provided in the grain is 37.

The chemical composition of the propellant utilized in the manufacture of grain 10 may be chosen from any one of the numerous United States Service Propellants generally known in the art. These propellants include the ones having the generally accepted designations M1, M2, M5, M6, M8, M9, M10, M15, M17, M26, M30 and M31. Further, over and above the foregoing propellants, it will be recognized by those skilled in these arts that any propellants, the characteristics of which conform to the Burning Law equation as stated above, may be utilized.

The length of the grain 10 may be varied as desired based upon the particular application with respect to which the grain is to be used. Thus, when high bulk loading densities are required, the ratio of the length of the grain to the cross-sectional distance between the edges of the grain may be in the range of 3 to 1, or less. For low bulk loading densities the same ratio should be greater than 3 to 1.

Figure 3:
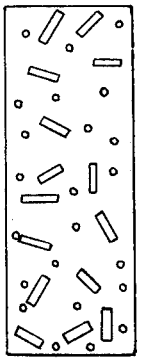
FIG. 3 is a cross-sectional view of packaging of the solid propellant grains of the present invention providing for low bulk loading densities.
Figure 4:
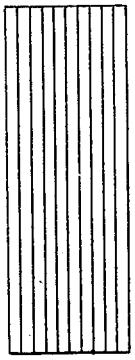
FIG. 4 is a cross-sectional view of the packaging of solid propellant grains according to the invention wherein high bulk loading densities are required.

With respect to to the packaging of the grains in use, the grains may be either packaged randomly as shown in FIG. 3, or in the event the ratio of length to diameter exceeds 10, the propellant grains will appear as sticks and may be coaxially oriented in packing in the manner shown in FIG. 4.

The selection of the particular packing mode, however, is within the skill of these having ordinary skill in these arts and is not a necessary consideration with respect to the practice of the present invention.

Figure 5:
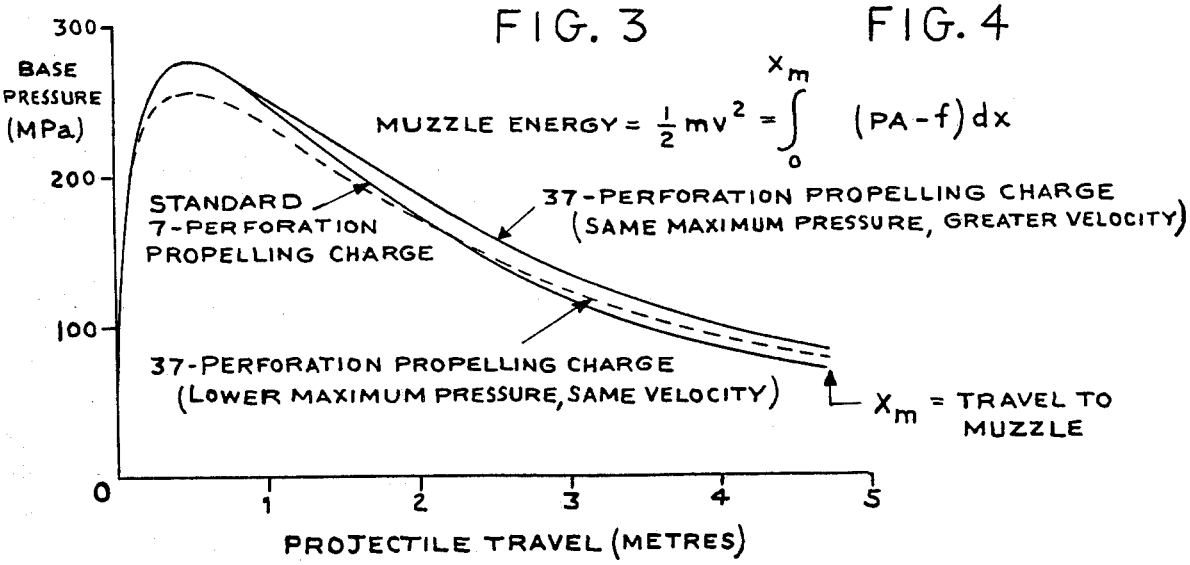
FIG. 5 is a graph showing relative chamber pressure versus projectile travel along the bore of a gun comparing known solid propellant performance with the performance of a solid propellant grain charge structured in accordance with the present invention.

As noted at the outset of the present disclosure a propellant charge comprising solid propellant grains structured in accordance with the present invention provides improved ballistic performance. Referring therefore to FIG. 5, there is shown in graphic form a comparison of the chamber pressure for a conventional propelling charge with the chamber pressure of a charge incorporating solid propellant grains structured in accordance with the invention. It can be seen that the maximum pressure achieved is substantially identical whereas the pressure for propelling the projectile is higher along substantially the entire length of travel of the projectile within the chamber for all points subsequent to the point of travel beyond that where maximum pressure occurs.

The net effect of this phenomenon is that the muzzle velocity of the projectile being propelled by solid propellant structured in accordance with the present invention is greater than that experienced by prior art charge structures by as much as 3%. This of course is an improved operation.

Figure 6:
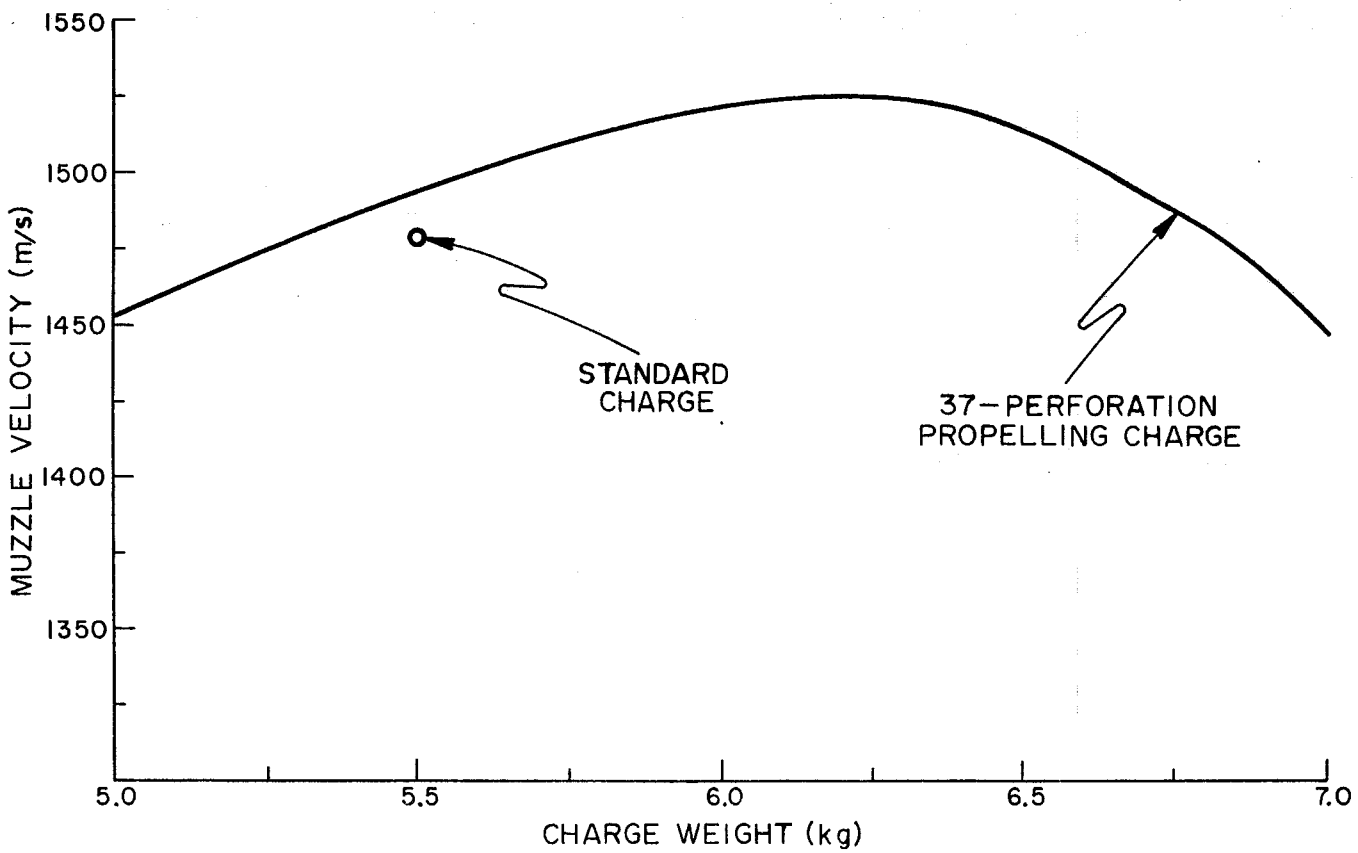
FIG. 6 is a graph showing a plot of the muzzle velocity of a 105 mm tank gun utilizing a 37 perforation grain propelling charge as a function of charge weight while maintaining a constant maximum pressure of 420 MPa.

For a particular gun, we predicted velocity as a function of charge weight for the standard maximum pressure of 420 MPa, as shown in FIG. 6. To maintain the maximum pressure constant, one has to increase the web size as the charge weight is increased. As indicated in FIG. 6, a point is reached where the web is so large that the propellant is not all burned in the gun, and a drop in velocity occurs when charge weight is increased beyond this point. The charge weight that gives the maximum velocity increase is seen to be about 6.2 kg.

A corollary of the higher-velocity-at-the-same-maximum-pressure benefit would be the ability to obtain the same velocity at a reduced pressure. By the same chain of reasoning used above, one could increase the pressure slightly after $P_{max}$ to compensate for a lower $P_{max}$ and thus maintain the same P-x integral and the same muzzle velocity. The reduction in peak stress (typically on the order of 5 percent) will be accompanied by an extension in the fatigue life of gun components, such as the gun tube and breech mechanisms. Since the life of many gun components are fatigue-limited, as opposed to wear-limited, an extension in fatigue life with a 37-perforation propellant charge could prove useful.

Another benefit of the 37-perforation grain design is the improved ignition characteristics arising from its physically larger grain size as compared to the standard 7-perforation (MP) grain. A 37-perforation granular propelling charge that replaces a 7-perforation granular charge will be composed of grains that are twice as large and one-fourth the number of the standard grains. The larger grains, when loaded randomly, as is the standard United States practice, give rise to larger interstices or spaces between the grains than is the case for the smaller 7-perforation grains. The larger interstices offer less resistance to the flow of gas through the propelling charge. Thus, during the ignition stage, igniter gases and products of combustion from the initial propellant burning travel faster through the propellant bed.

This promotes a more nearly simultaneous and uniform ignition of the whole propelling charge and reduces the danger of localized ignition.

The preliminary firing evaluation of a 37-perforation pilot lot using an instrumented 105-mm gun is summarized in Table 1 below:

TABLE 1

FIRING RESULTS FOR 105-mm GUN WITH 37-PERFORATION PILOT LOT

| Round | Charge Weight (kg) | $P_{Max}$ (MPa) | $V_{MuZ}$ (m/s) |
|---|---|---|---|
| 1 | 4.08 | 141 | 1006.3 |
| 2 | 4.99 | 215 | 1203.7 |
| 3 | 5.90 | 332 | 1403.2 |
| 4 | 6.35 | 422 | 1510.0 |
| 5 | 6.25 | 390 | 1978.2 |
| 6 | 6.30 | 399 | 1493.7 |
| 7 | 6.35 | 399 | 1499.5 |
| 8 | 6.35 | 414 | 1502.6 |

When the results for the three rounds fired with the 6.35-kg charge weight are averaged, we obtain a velocity of 1504 m/s at the maximum pressure of 412 MPa. This velocity is 26 m/s above the standard velocity of 1478 m/s obtained at the same peak pressure with a standard 7-perforation propelling charge.

We noted that Round 5 with a 6.26-kg charge weight gave the standard 1478.2 m/s muzzle velocity with a maximum pressure of 390 MPa, which is about five percent below the normal pressure. This illustrates the corollary of the higher-velocity, same pressure benefit: namely, we can obtain the same velocity at a lower pressure.

For purposes of improved economy, it should be recognized that a solid propellant grain charge may be utilized to provide a muzzle velocity equal to that of the standard perforation charge but which requires a less maximum pressure. This represented in FIG. 5 by the curve shown with the broken line.

Thus, it can be seen that through the desired choice of either comparative muzzle velocity or comparative maximum pressure, benefits may be achieved by utilization of a solid propellant grain structure according to the invention.

It will be recognized by those skilled in these arts that the solid propellant grain structure according to the invention may be manufactured in accordance with techniques generally known in the field e.g. casting and the like.

It will also be recognized by those skilled in these arts that the mechanism for achieving the improved characteristics of the ballistics charge is achieved through providing optimum surface burn area which burn surface increases relatively over the life of the burn thus contributing to the maintenance of the relatively increased pressure rate subsequent to the achievement of maximum pressure.

I claim:

1. A solid propellant grain structure having a smooth exterior surface comprising:

a longitudinally extending, progressive externally burning grain having a generally hexagonal cross-sectional shape, said grain having six flat outer surfaces joined by rounded longitudinal edges;

a plurality of spaced equally sized longitudinally extending throughbores formed in said grain wherein an optimum throughbore configuration includes seven throughbores along a line connecting diametrically opposite edges, said throughbores including;

perimetric throughbores positioned adjacent said longitudinally extending flat outer surfaces; and internal throughbores positioned so that interstial distances between adjacent perimetric and internal throughbores are substantially equal, and wherein extrastitial distances between each of said perimetric throughbores and the normally adjacent longitudinally extending outer surface of the grain are substantially equal to said interstitial distance, which includes;

each of said rounded longitudinal edges having a radius of generation equal to one-half the diameter of said internal and perimetric throughbores plus the value of said extrastitial distances;

said substantially equal interstitial and extrastitial distances promoting more nearly simultaneous and uniform ignition and improving burning characteristics of said grain by maintaining higher average pressures and velocity during projectile acceleration without increasing maximum pressure.

2. A solid propellant grain structure according to claim 1 wherein the longitudinal axes of said internal and perimetric throughbores are parallel.

3. A solid propellant grain structure according to claim 1 wherein thirty-seven throughbores are provided.

4. A solid propellant grain structure according to claim 2 wherein said longitudinal surfaces of said hexagonal grain meet at common edges, which edges are rounded so as to maintain said constant extrastitial distance.

5. A solid propellant grain structure according to claim 4 wherein the radius of generation of said rounded edges is equal to one-half the diameter of the throughbores plus the value of said extrastitial distance.

6. A solid propellant grain structure according to claim 5 wherein thirty-seven throughbores are provided.

* * * * *